US005156132A

United States Patent [19]

Iwanaga

[11] Patent Number: 5,156,132

[45] Date of Patent: Oct. 20, 1992

[54] FUEL INJECTION DEVICE FOR DIESEL ENGINES

[75] Inventor: Takashi Iwanaga, Kariya, Japan

[73] Assignee: Nippondenso Co., Ltd., Kariya, Japan

[21] Appl. No.: 508,712

[22] Filed: Apr. 16, 1990

[30] Foreign Application Priority Data

Apr. 17, 1989 [JP] Japan ..... 1-096876

[51] Int. Cl.[5] ..... F02M 37/04

[52] U.S. Cl. ..... 123/496; 123/447; 123/467

[58] Field of Search ..... 123/467, 458, 500, 501, 123/447, 496; 239/88-95

[56] References Cited

U.S. PATENT DOCUMENTS

| | | | |
|---|---|---|---|
| 4,535,939 | 8/1985 | Skinner . | |
| 4,545,352 | 10/1985 | Jourde | 123/467 |
| 4,546,739 | 10/1985 | Nakajima | 123/299 |
| 4,603,671 | 8/1986 | Yoshinaga | 123/467 |
| 4,640,252 | 2/1987 | Nakamura | 123/467 |
| 4,719,889 | 1/1988 | Amann et al. . | |
| 4,753,212 | 6/1988 | Miyaki et al. . | |
| 4,777,921 | 10/1988 | Miyaki et al. . | |
| 4,784,101 | 11/1988 | Iwanaga | 123/467 |

FOREIGN PATENT DOCUMENTS

| | | |
|---|---|---|
| 2534976 | 4/1984 | France . |
| 0119894 | 9/1984 | France . |

*Primary Examiner*—Carl S. Miller

*Attorney, Agent, or Firm*—Cushman, Carby & Cushman

[57] ABSTRACT

A Diesel fuel injection device has a pressure accumulation piping for accumualting a fuel at a high pressure and an injector for injecting the fuel supplied by the pressure accumulating piping. The injector including a nozzle needle operative to open and close an injection orifice and a three-way solenoid valve operative to control the fuel pressure acting on the nozzle needle. The three-way solenoid valve is controlled to actuate the nozzle needle and to cause the fuel in the pressure accumulation piping to be injected through the injection orifice. A control valve is provided to control the injection rate characteristic to provide a boot-type injection characteristic. A boot type invention characteristic that is defined by a first characteristic in which the injection rate is substantially constant for a predetermined time period, a subsequent second characteristic in which the injection rate is gradually increased from the first characteristic, and a subsequent third characteristic in which the injection rate is suddenly decreased from the second characteristic; whereby operation noise is be reduced.

23 Claims, 10 Drawing Sheets

FUEL INJECTION DEVICE FOR DIESEL ENGINES

BACKGROUND OF THE INVENTION

The present invention relates to a fuel injection device for Diesel engines.

DESCRIPTION OF THE PRIOR ART

Japanese Unexamined Patent Publication No. 59-165858 discloses a fuel injection system for Diesel engines which comprises a pressure-accumulation common piping called as "common rail" for accumulating a fuel at a high pressure and injectors for injecting the fuel. Each injector has a nozzle needle slidably disposed to open and close an injection orifice and a back pressure chamber for containing a fuel pressure acting on the nozzle needle. A three-way solenoid valve is provided to change over the back pressure chamber pressure between a first fuel pressure on a high pressure side of the system and a second fuel pressure on a low pressure side thereof to operate the nozzle needle for the purpose of injection of the fuel from the common rail. In order to control the rate of injection, a one-way orifice is provided at the inlet of the back pressure chamber. The orifice is effective to restrict only the flow of the fuel from the back pressure chamber to the low pressure side of the system to thereby provide a fuel injection of a delta type that is characterized by a gentle or mild increase of the injection rate and a sharp decrease or sudden interruption of the injection.

On the other hand, for Diesel engines, fuel injections of a boot type is preferred which is characterized by an initial injection stage of a constant injection rate which is followed by an increase in that injection rate which sharply drops in the final stage.

In the injector which utilizes the one-way orifice, however, the rate of injection is determined solely by the diameter of the one-way orifice. In addition, the velocity of the nozzle needle is almost constant during the time while the nozzle needle is moved upwardly. Thus, the smaller the initial injection rate is the smaller the diameter of the one-way orifice is, and the longer the period the injection orifice is restricted by the nozzle needle, the greater the resultant decrease in the ratio of the maximum injection rate period to the whole injection period.

SUMMARY OF THE INVENTION

It is, therefore, an object of the present invention to provide a boot type injection characteristic in a Diesel fuel injection device which is operative to inject a high pressure fuel from a common rail through an injector having a nozzle needle and a three-way solenoid valve in such a way as to reduce operation noise.

According to one feature of the present invention, there is provided a Diesel fuel injection device having a nozzle needle operative to open and close an injection orifice. The injection device includes control means operative to control the operation of the nozzle needle such that the nozzle needle has a first stroke in which the nozzle needle is moved from a first position where the nozzle needle closes the injection orifice to a second position where the nozzle needle is lifted a predetermined distance, a second stroke in which the nozzle needle is kept in the second position for a predetermined time period, a third stroke in which the nozzle needle is lifted from the second position to a third, maximum lift position, and a fourth stroke in which the nozzle needle is moved from the third, maximum lift position to a fourth position where the nozzle needle again closes the injection orifice.

According to a second feature of the invention, there is provided a Diesel fuel injection device having a nozzle needle operative to open and close an injection orifice to allow fuel from a pressure accumulation piping to be injected through the nozzle orifice. The injection device includes means for controlling the injection rate characteristic such that the injection has a first characteristic that the injection rate is substantially constant for a predetermined time period, a subsequent second characteristic that the injection rate is gradually increased from the first characteristic, and a subsequent third characteristic that the injection rate is suddenly decreased from the second characteristic.

According to a third feature of the present invention, there is provided a Diesel fuel injection system which includes a pressure accumulation piping for accumulating a fuel at a high pressure. The injector includes a nozzle needle slidably disposed to open and close an injection orifice, a pressure chamber for containing a pressure acting on the nozzle needle, and a control valve operative to change over the pressure in the pressure chamber between a high fuel pressure, in a high pressure side of the system formed by the pressure accumulation piping, and a low fuel pressure in a low pressure side of the system. The control valve is controlled to actuate the nozzle needle to allow the fuel from the pressure accumulation piping to be injected through the injection orifice. The system further includes a control chamber for containing a part of the high pressure in the pressure chamber. A control means included on the system is operative to communicate the control chamber with the low pressure side through restriction passage means when the control valve has changed over the pressure in the back pressure chamber from the high pressure to the low pressure. The control means is further operative to cause the pressure in the control chamber to act on the nozzle needle when the nozzle needle is lifted a predetermined distance.

The above and other objects, features and advantages of the present invention will be made more apparent by the following description with reference to the accompanying drawings.

DESCRIPTION OF PREFERRED EMBODIMENTS

Figure 1:
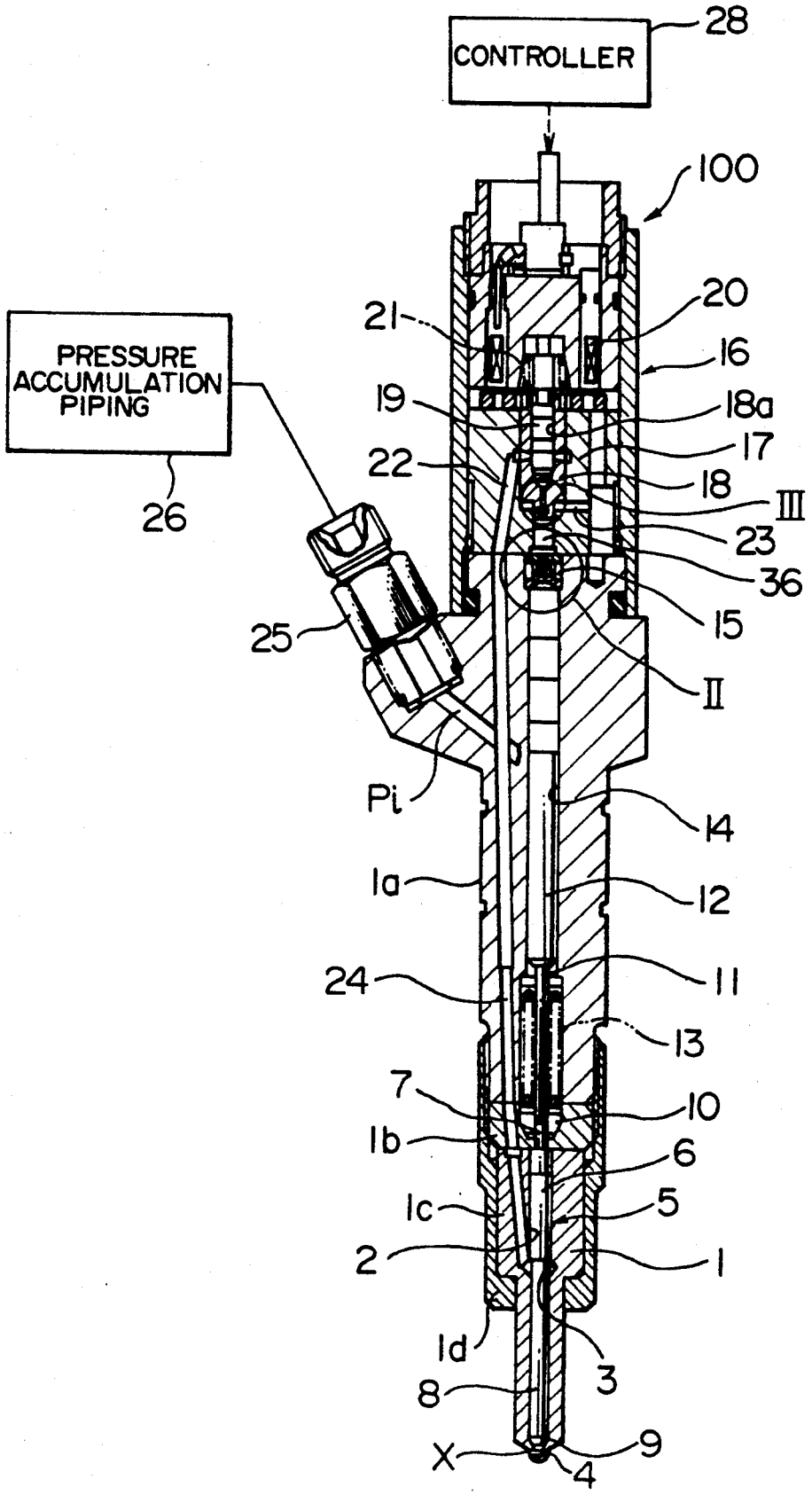
FIG. 1 is a partly diagrammatic and partly longitudinal sectional view of an embodiment of a Diesel fuel injection device according to the present invention.

Referring to FIG. 1, an injector 100 comprises a lower body 1*a*, a joint portion 1*b* and a valve casing *c*. These elements are connected together by a retaining ring 1*d*. The valve casing 1*c* has formed therein a valve-sliding bore 2 and a fuel reservoir 3. A nozzle needle 5 has a large-diameter section 6 communicated with the fuel reservoir 3 and slidably received in the valve-sliding bore 2. The large-diameter section 6 of the nozzle needle 5 is connected at an upper end with an integral connection section 7 and at a lower end with an integral small-diameter section 8 which in turn is connected with an integral valve section 9 which is movable into and out of sealing engagement with a valve seat X to close and open an injection orifice 4. The upper end of the connection section 7 of the nozzle needle 5 is connected with an integral flange 10, a piston pin 11 and a piston 12. The nozzle needle 5 is resiliently biased by a spring 13 in an orifice-closing direction. The piston 12 is slidably received in a cylinder 14 communicated with a pressure chamber 15.

Figure 2:
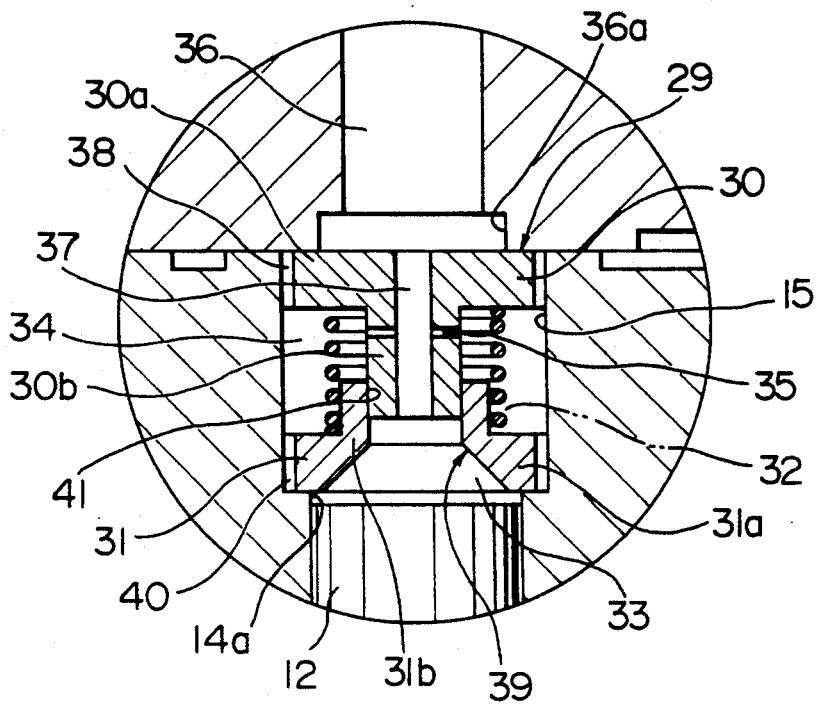
FIG. 2 is an enlarged sectional view of the part of the fuel injection device surrounded by a circle II shown in FIG. 1.

The pressure chamber 15 accommodates a plate valve 29 comprising a first valve member 30, a second valve member 31 and a spring 32, as will be best seen in FIG. 2. The first and second valve members 30 and 31 cooperate together to divide the pressure chamber 15 into a back pressure chamber 33 and a control chamber 34.

The first valve member 30 is slidable in the pressure chamber 15 and has a flange 30*a* for closing an opening 36*a* of a passage 36 leading to a three-way solenoid valve 16 to be described later and a cylindrical stem portion 30*b* having formed therein an inner axial passage 37 which forms a part of the back pressure chamber 33. The flange 30*a* is resiliently urged by the spring 32 into sealing engagement with an outer periphery cf the opening 36*a*. Axial grooves 38 are formed in the outer periphery of the flange 30*a* to allow the fuel in the passage 36 to flow into the control chamber 34 when the flange 30*a* is moved away from the opening 36*a*. The cylindrical stem portion 30*b* has formed therein a small restriction passage 35 which communicates the back pressure chamber 33 and the control chamber 34.

The second valve member 31 is slidably disposed in the pressure chamber 15 and has a flange 31*a* for closing an opening 14*a* of a cylinder 14 and a cylindrical stem portion 31*b* having formed therein an inner axial passage 41 in which the cylindrical stem portion 30*b* of the first valve member 30 is slidably received. The bottom face of the flange 31*a* has formed therein a tapered or frusto-conical recess 39 which defines a part of the back pressure chamber 33. Axial grooves 40 are formed in the outer periphery of the flange 31*b* to allow the fuel in the control chamber 34 to flow therefrom through the grooves to facilitate a quick upward movement of the second valve member 31 when it is lifted by the piston 12, as will be described later. The flange 31*a* is resiliently urged by the spring 32 into sealing engagement with the outer periphery of the opening 14*a* of the cylinder 14. When the nozzle needle 5 is lifted beyond a predetermined distance, the upper end of the piston 12 is brought into engagement with the bottom face of the flange 31*a* to upwardly move the second valve member 31 together with the nozzle needle 5.

The three-way valve 16 is disposed above the piston 12. More specifically, a cylinder 17 slidably receives an outer valve 18 having an inner bore 18*a* in which is disposed an inner valve 19. When a coil 20 is deenegized, the outer valve 18 is moved by a spring 21 to a lower position to allow the pressure chamber 15 to be communicated with a passage 22 through the passage 36. When the coil 20 is energized, the outer valve 18 is moved upwardly to allow the pressure chamber 15 to be communicated with a drain passage 23 leading to a drain tank, not shown.

Figure 3:
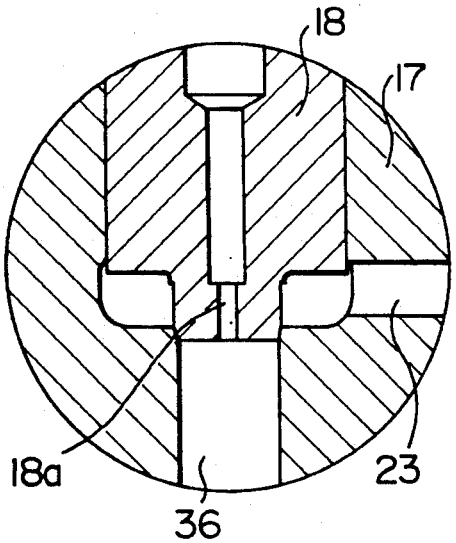
FIG. 3 is an enlarged sectional view of the part of the fuel injection device surrounded by a circle III shown in FIG. 1.
Figure 4:
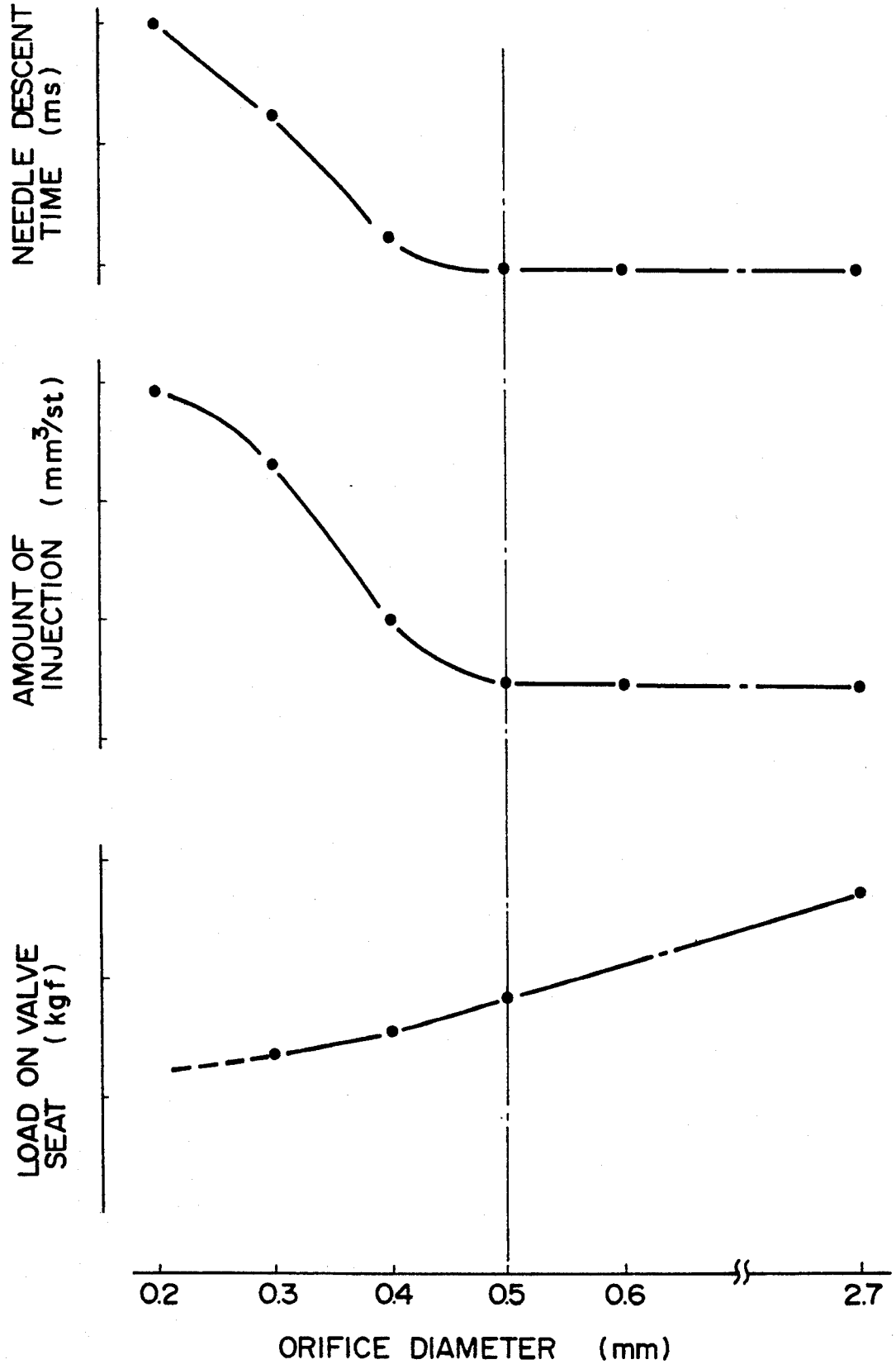
FIG. 4 graphically illustrates the relationship between the outer valve orifice diameter and the operation characteristic of the injection device.

The outer valve 18 has a lower end in which an orifice 18*a* is formed, as shown in FIG. 3. This orifice 18*a* is provided to reduce the magnitude of shock which is exerted to the valve seat X by the valve section 9 of the nozzle needle 5 which is moved by a high pressure fuel which rushes into the back pressure chamber when the coil 20 is deenergized. The orifice 18*a* preferably has a diameter of 0.5 mm. If the orifice 18*a* has a smaller diameter, the nozzle needle 5 takes a longer time to be moved downwardly and the amount of injected fuel is varied. The orifice diameter is determined to avoid the occurrence of such problem. FIG. 4 shows the relationship of the diameter of the orifice 18*a* to the needle descent time t(ms), the injected amount of fuel ($mm^3$/st.) and the load applied to the valve seat. It will be seen in FIG. 4 that an orifice having a diameter of 0.5 mm is most preferred to reduce the load on the valve seat without adversely affecting the needle descent time and the amount of injection.

Figure 5:
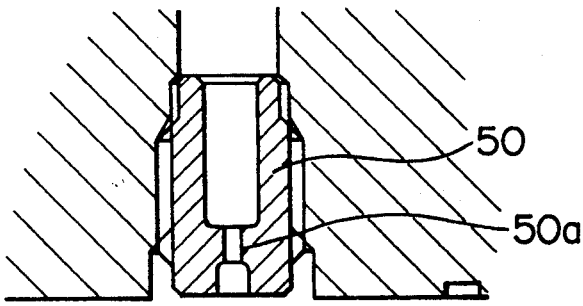
FIG. 5 shows a modification to the structure shown in FIG. 3.

The position of the orifice 18*a* is not limited to the lower end of the outer valve 18. FIG. 5 shows a modification in which a member 50 having an orifice 50*a* is interposed between the three-way solenoid valve 16 and the pressure chamber 15.

A fuel supply passage 24 is formed in the casing member 1 and has an end connected to the fuel reservoir 3, the other end of the fuel supply passage 24 being connected to the pasage 22 in the three-way solenoid valve 16.

A pressure accumulation piping 26 accumulates therein a high pressure of fuel supplied from a high pressure fuel supply pump, not shown, and supplies the high pressure fuel to the injector 100 through a fuel inlet 25 thereof. Such injector 100 is provided for each of cylinders of an associated engine.

In operation, the high pressure fuel in the pressure accumulation piping 26 is supplied therefrom to the injector 100 through the fuel inlet 25. The fuel then flows from the inlet 25 through the fuel supply passage 24 to the fuel reservoir 3 as well as to the three-way solenoid valve 16.

At this time, if the three-way solenoid valve 16 is deenergized, the force of the spring 32 keeps the outer valve 18 engaged with its valve seat, so that the fuel supplied into the three-way solenoid valve 16 moves the inner valve 19 upwardly and flows into the passage 36. The fuel then flows from the passage 36 into the pressure chamber 15. After the lapse of a predetermined time period, the pressure chamber 15 (back pressure chamber 33 and control chamber 34) is filled with the high pressure fuel. The first and second valve members 30 and 31 in the pressure chamber 15 are resiliently urged by the spring 14*a* into sealing engagement with the outer peripheries of the openings 36*a* and 14*a*, respectively.

A controller 28 receives signals from a cylinder judgement sensor, not shown, a cam angle sensor, not shown, and a throttle position sensor, not shown, and actuates the three-way solenoid valve 16 at a predetermined fuel injection timing. When the three-way solenoid valve 16 is energized by the controller 28, the outer valve 18 is electro-magnetically driven upwardly, as viewed in FIG. 1, so that the fuel in the back pressure chamber 33 and the passage 36 is released therefrom through a drain passage 23 to a low pressure side of the fuel injection system. The flow of the fuel from the control chamber 34 is restricted by the restriction passage 35. Thus, the pressure in the control chamber 34 is not immediately lowered. Accordingly, the control chamber 34 is kept at a high pressure for a predetermined time period.

Figure 6A:
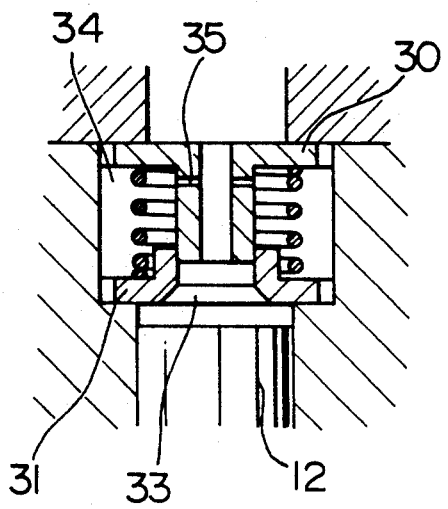
FIGS. 6A to 6D illustrate steps of operation of the embodiment.
Figure 6B:
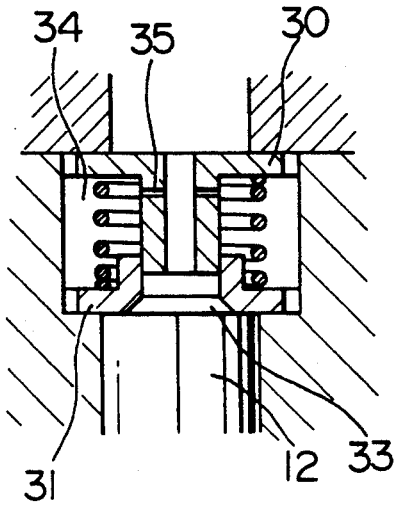

When the high pressure in the back pressure chamber 33 is released therefrom to the low pressure side of the system, the piston 12 is lifted into contact with the second valve member 31, as shown in FIG. 6B, whereby an injection of the fuel is commenced. At this moment, because the control chamber 34 is at a high pressure, the upward movement of the piston 12 is momentarily stopped.

Figure 6C:
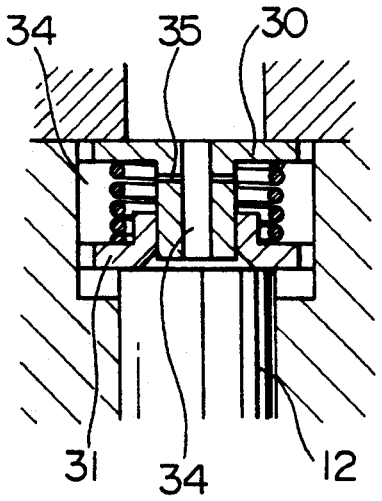

Thereafter, the high pressure fuel in the control chamber 34 flows therefrom through the restriction passage 35 to the low pressure side of the system to lower the pressure in the control chamber 34, with a result that the piston 12 is again moved upwardly together with the second valve member 31 until the nozzle needle 5 is lifted to its fully lifted position so that the rate of injection becomes maximum, as will be seen in FIG. 6C.

Figure 6D:
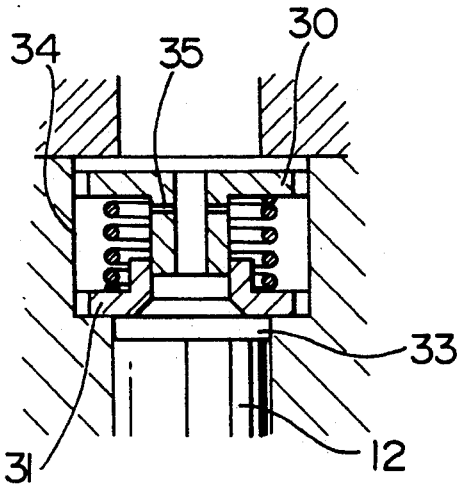

When the three-way solenoid valve 16 is deenergized, the high pressure fuel is fed through the three-way solenoid valve 16 and the passage 36 towards the back pressure chamber 33, so that the first valve member 30 is moved by the high fuel pressure against the force of the spring 32. Thus, the flange 30*a* of the first valve member 31 is moved away from the opening 36*a* to allow the high pressure fuel to flow into the control chamber 34. The pressure in the control chamber 34 is immediately raised to move the second valve member 31 downwards. The downward force of the second valve member 31 cooperates with the pressure in the back pressure chamber 33 to immediately move the piston 12 downards, with a result that the injection of the fuel is promptly terminated, as will be seen in FIG. 6D.

Figure 7:
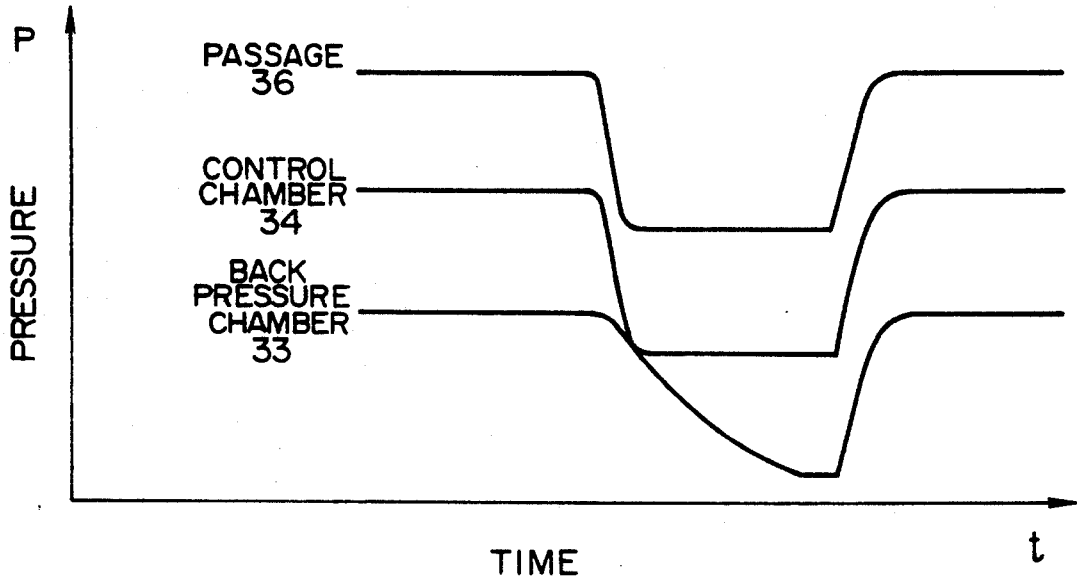
FIG. 7 is a time chart showing the pressure variation characteristic of the embodiment.
Figure 8:
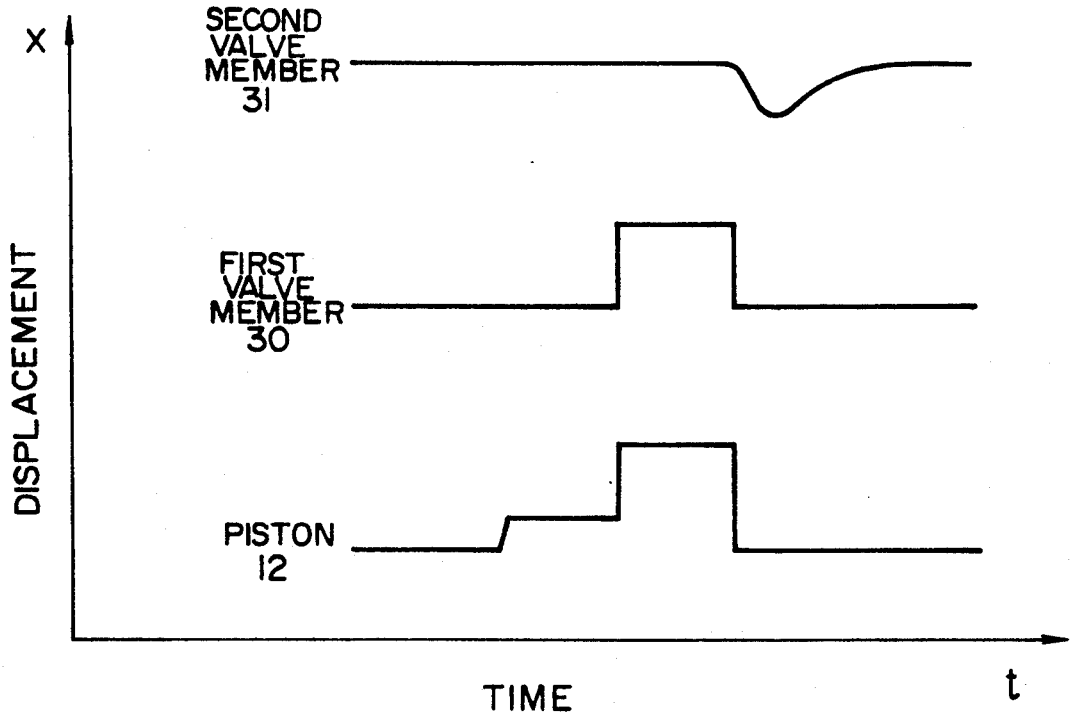
FIG. 8 is a time chart showing the displacement characteristic of the embodiment.

FIG. 7 graphically shows how the pressure in the passage 36, the control chamber 34 and the back pressure chamber 33 are varied during the operation described above. FIG. 8 also graphically shows how the first valve member 30, the second valve member 31 and the piston 12 are displaced during the above-described operation.

As will be seen from the foregoing description, the embodiment of the present invention described above provides the boot-type fuel injection characteristic.

Figure 9:
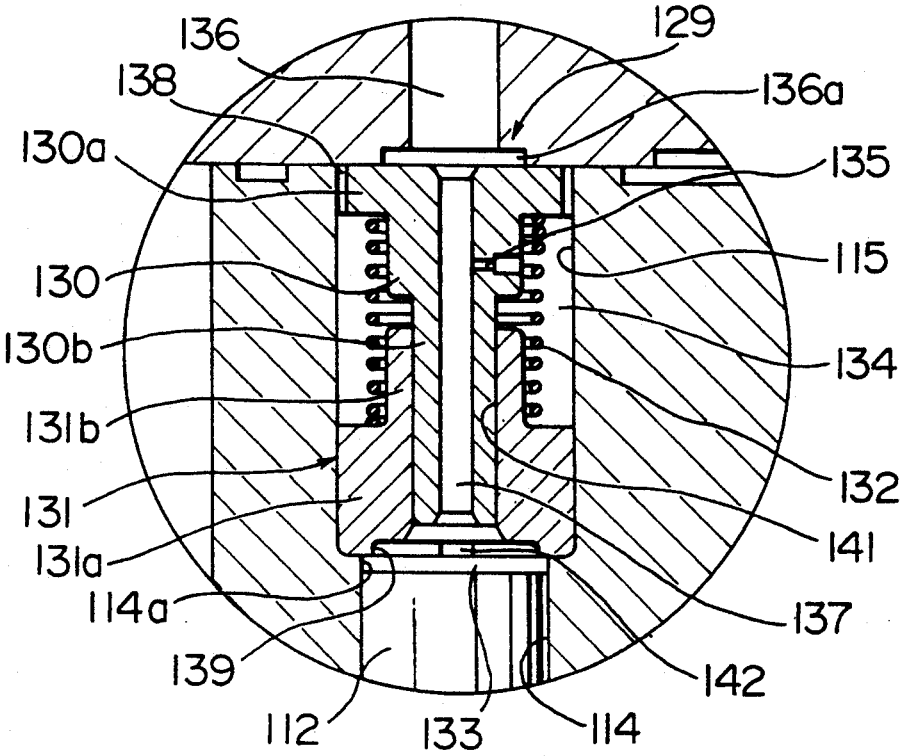
FIG. 9 is an enlarged sectional view of a part of a second embodiment of the present invention.

A second embodiment of the present invention will be described below with reference to FIG. 9.

The second embodiment comprises a modification to the plate valve. Accordingly, the following description will be directed to a modified plate valve 129 shown in FIG. 9.

The plate valve 129 comprises a first valve member 130, a second valve member 131 and a spring 132, as in the first embodiment. The first and second valve members 130 and 131 cooperate to divide a pressure chamber 115 into a back pressure chamber 133 and a control chamber 134.

The first valve member 130 is slidably disposed in the pressure chamber 115 and has a flange 130*a* for closing an opening 136*a* of a passage 136 and a cylindrical stem portion 130*b* having formed therein an inner axial passage 137 which forms a part of the back pressure chamber 133. The flange 130*a* is resiliently urged against an outer periphery of the opening 136*a* and has communication grooves 138 formed in the outer periphery of the flange 130*a* to introduce the fuel from the passage 136 into the control chamber 134 when the flange 130*a* is moved away from the opening 136*a*. The cylindrical stem portion 130*b* has formed therein a restriction passage 135 of a small diameter through which the back pressure chamber 133 is communicated with the control chamber 134.

The second valve member 131 is slidably disposed in the pressure chamber 115 and has a flange 131*a* having an outer periphery closing an opening 114*a* of a cylinder 114. The second valve member 131 further has a cylindrical stem portion 131*a* having formed therein an inner axial passage 141 which slidably receives the stem portion 130*b* of the first valve member 130. The flange 131*a* has a bottom face formed therein with a recess 139 faced to the opening 114*a* of the cylinder 114. The flange 131*a* is formed therein with diametrically extending grooves 141 having radially inner ends open to the recess 139. The flange 131*a* is resiliently urged by the spring 132 into sealing engagement with the outer periphery of the opening 114*a*. When the nozzle needle 5 is lifted beyond a predetermined distance, the piston 112 is brought into engagement with the flange 131*a* to move the second valve member 131 upwards.

Figure 10A:
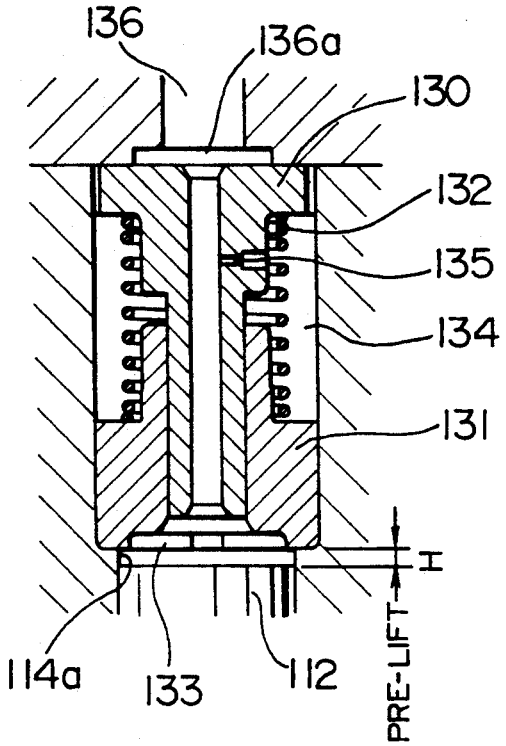
FIGS. 10A to 10D shows steps of operation of the second embodiment of the invention.

In operation, the fuel which has been fed into the passage 136 flows therefrom into the pressure chamber 115. After the lapse of a predetermined time period, the pressure chamber 115 (the back pressure chamber 133 and the control chamber 134) is filled with the high pressure fuel, so that the first and second valve members 130 and 131 are urged by the spring 132 into engagement with the peripheries of the openings 136*a* and 114*a*, respectively, as shown in FIG. 10A.

Figure 10B:
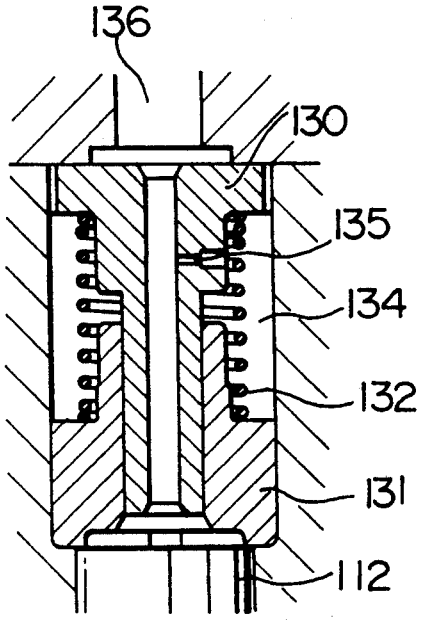
Figure 10C:
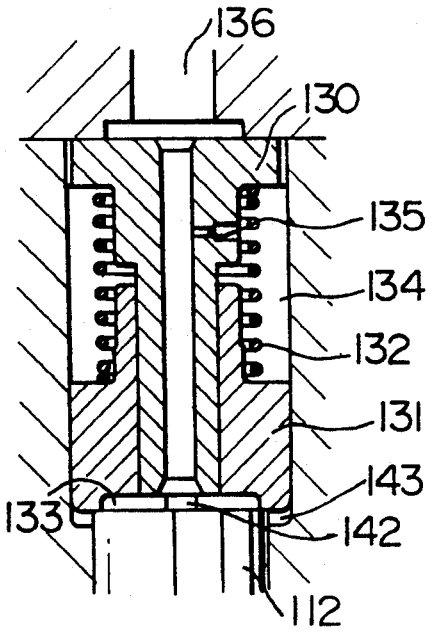

When the high pressure fuel in the back pressure chamber 133 is released therefrom through the passage 136 to the lower pressure side of the injection system, the piston 112 is lifted into engagement with the second valve member 131, as shown in FIG. 10B, whereby an injection of the fuel is commenced. The flow of the fuel from the control chamber 134 is restricted by a restriction passage 135. Thus, the pressure in the control chamber 134 is not immediately lowered, with a result that the control chamber 134 is kept at a high pressure for a predetermined time period. Accordingly, because the control chamber 134 is at a high pressure when the piston 112 is moved into engagement with the second valve member 131, the upward movement of the piston 112 is momentarily stopped. Thereafter, the high pressure fuel in the control chamber 134 is released therefrom through the restriction passage 135 to the low pressure side of the system to lower the pressure in the control chamber 134. In consequence, the piston 112 is again lifted upwardly together with the second valve member 131 until the piston 112 is moved to its fully lifted postion. Thus, the rate of injection becomes maximum, as will be seen in FIG. 10C. At this time, an annular space 143 is formed under the outer periphery of the bottom face of the second valve member 131 and around the outer peripheral surface of the piston 112. However, no vacuum is created in the annular space 143 because this space is communicated with the back pressure chamber 133 through the grooves 142. During the operation described above, the high pressure fuel in the control chamber 134 is confined by the first and second valve members 130 and 131 and can flow therefrom to the lower pressure side of the system only through the restriction passage 135. Accordingly, the nozzle needle 5 is moved upwardly more slowly than in the first embodiment.

Figure 10D:
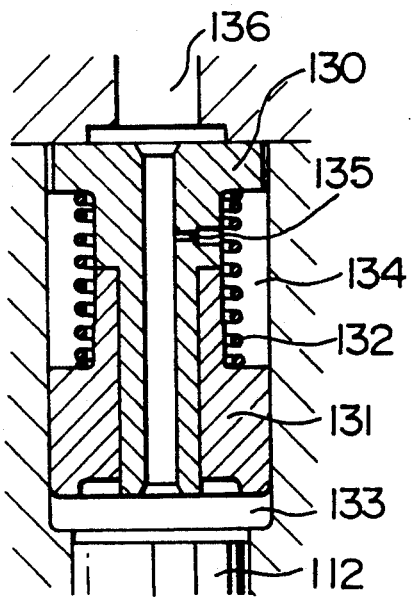

When the high pressure fuel is again fed through the passage 136 into the back pressure chamber 133, the pressure therein immediately moves the piston 112 downwards to finish the injection, as will be seen in FIG. 10D.

Figure 11:
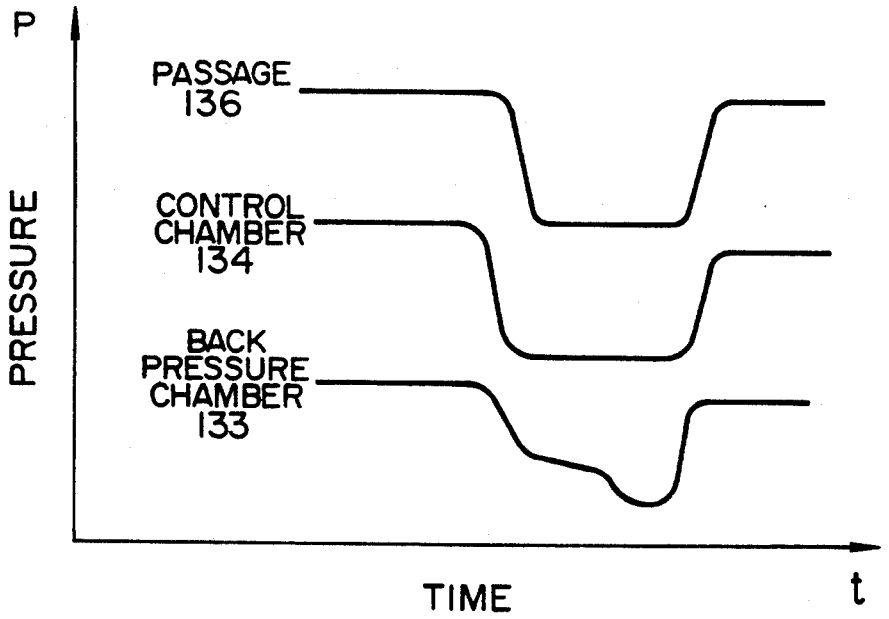
FIG. 11 is a time chart showing the pressure variation characteristic of the second embodiment.
Figure 12:
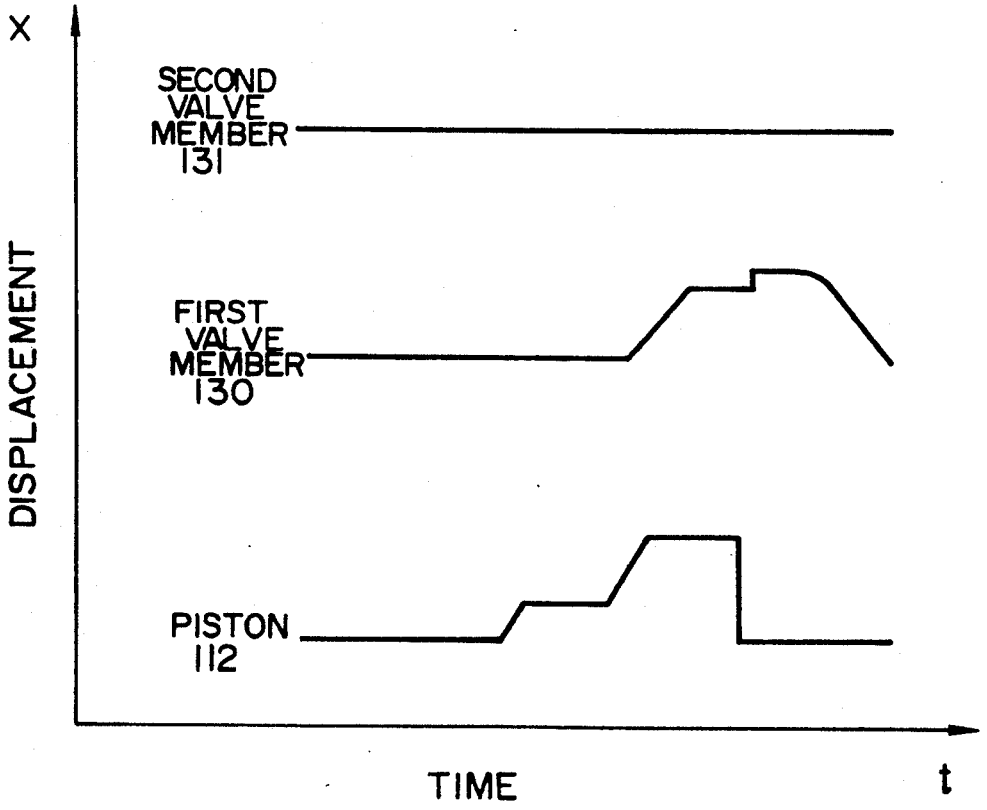
FIG. 12 is a time chart showing the displacement characteristic of the second embodiment.

FIG. 11 graphically shows how the pressures in the passage 136, the control chamber 134 and the back pressure chamber 133 are varied during the operation described above. FIG. 12 also graphically shows how the first and second valve members 130 and 131 and the piston 112 are displaced during the above-described operation.

Figure 13:
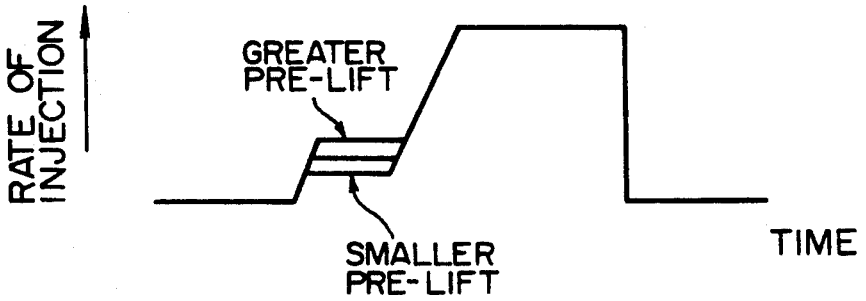
FIGS. 13 to 15 graphically illustrate the injection characteristics of the second embodiment.
Figure 14:
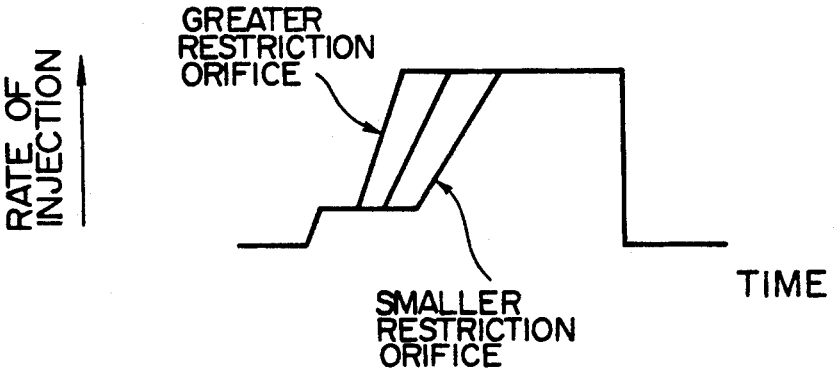
Figure 15:
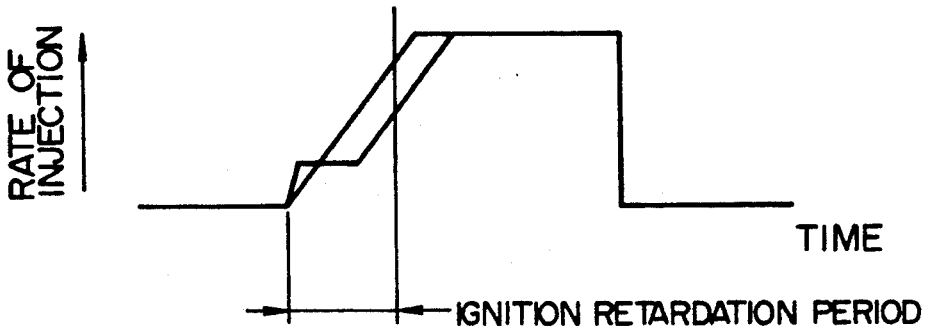

The pre-lift H of the nozzle needle 5 shown in FIG. 10A can be adjsuted to determine the rate of the initial injection as shown in FIG. 13. The diameter of the restriction passage 135 can also be adjusted to control the velocity of the upward movement of the nozzle needle as shown in FIG. 14.

As will be understood from the foregoing description, the second embodiment of the invention can reduce the amount of fuel injected during an ignition retardation period better than in the prior art delta type injection for thereby preventing the straight-out combustion to advantageously reduce the production of NOx.

Figure 16:
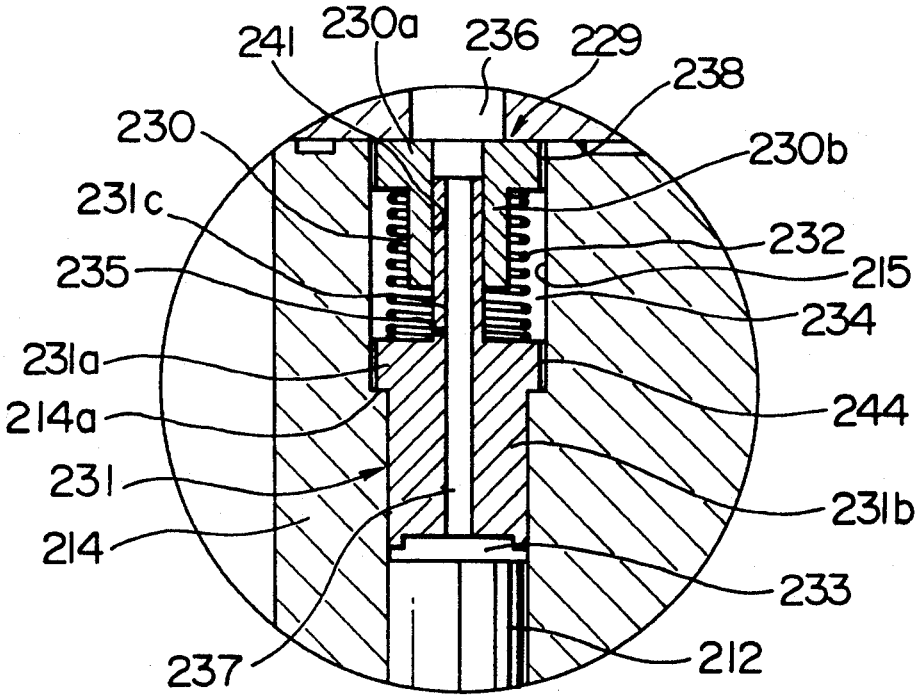
FIG. 16 is similar to FIG. 9 but illustrates a third embodiment of the present invention.

Then, a third embodiment of the invention will be described with reference to FIG. 16.

This embodiment also comprises a modification to the plate valve as in the second embodiment of the invention. Thus, the description will be directed to a modified plate valve 229 shown in FIG. 16.

The plate valve 229 comprises a first valve member 230, a second valve member 231 and a spring 232. The first and second valve members 230 and 231 cooperate together to divide a pressure chamber 215 into a back pressure chamber 233 and a control chamber 234. The first valve member is slidably disposed in the pressure chamber 215 and has a flange **230*a* for closing a passage 236 and a cylindrical stem portion 230*b* having formed therein an inner axial passage 241 which slidably receives a cylindrical stem portion 231*c* of the second valve member 231 to be described later. The flange 230*a* is resiliently urged by the spring 232 into sealing engagement with an outer periphery of the passage 236. Grooves 238 are formed in the outer periphery of the flange 230*a* to allow the fuel in the passage 236 to flow therefrom into the control chamber 234 when the flange 230*a* is moved out of engagement with the outer periphery of the passage 236**.

The second valve member 231 is slidably disposed in the pressure chamber 215 and also includes a flange **231*a* adapted to engage with an annular shoulder 214*a* formed on the inner peripheral surface of a cylinder 214. The second valve member 231 also includes a sliding portion 231*b* disposed in slidable sealing engagement with the inner peripheral surface of the cylinder 214. The sliding portion 231*b* extends from the end face of the flange 231*a* remote from the cylindrical stem portion 213*c*. An inner axial passage 237 is formed in the second valve member 231 and forms a part of the back pressure chamber 233. The flange 231*a* has its outer peripheral surface formed therein with communication grooves 244 to be made apparent later. The flange 231*a* is resiliently urged into engagement with the shoulder 214*a*. When a piston 212 is lifted beyond a predetermined distance, the upper end of the piston 212 is brought into engagement with the bottom end of the sliding portion 231*b*, so that the piston 212 and the second valve member 231 are moved together upwards against the spring 232 to move the flange 231*a* out of engagement with the shoulder 214*a*. At this time, the communication grooves 244 allow the fuel in the control chamber 234 to flow through the grooves 244 into an annular space 243 left under the flange 231*a* and around the outer peripheral surface of the sliding portion 231*b***.

Figure 17A:
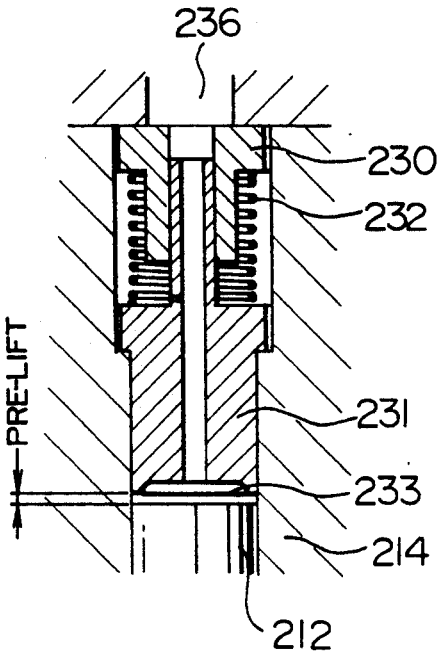
FIGS. 17A to 17D illustrate steps of operation of the third embodiment.

In operation, the fuel fed into the passage 236 flows into the pressure chamber 215. After the lapse of a predetermined time period, the pressure chamber 215 (the back pressure chamber 233 and the control chamber 234) is filled with the high pressure fuel. The first and second valve members 230 and 231 are urged by the spring 232 into engagement with the outer periphery of the passage 236 and the shoulder **214*a*, respectively, as shown in FIG. 17A**.

Figure 17B:
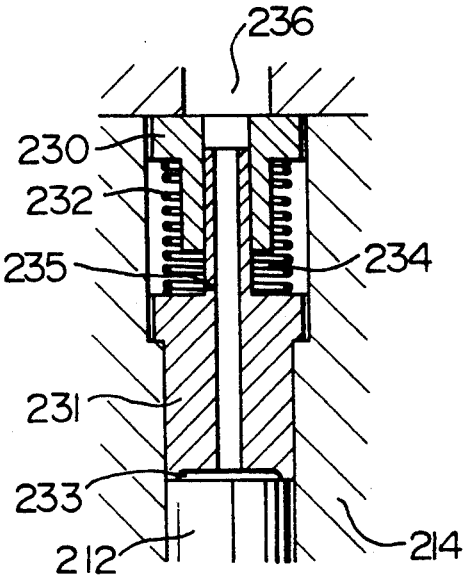

When the high pressure fuel in the back pressure chamber 233 is released through the passage 236 to a low pressure side of the injection system, the piston 212 is lifted into engagement with the second valve member 231, as shown in FIG. 17B, to initiate an injection of the fuel. At this moment, because the fuel in the control chamber 234 is allowed to flow therefrom only through the restriction passage 235, the control chamber 234 is kept at a high pressure for a predetermined time period. Thus, because the control chamber 234 is at the high pressure when the piston 212 is brought into engagement with the second valve member 231, the upward movement of the piston 212 is stopped momentarily.

Figure 17C:
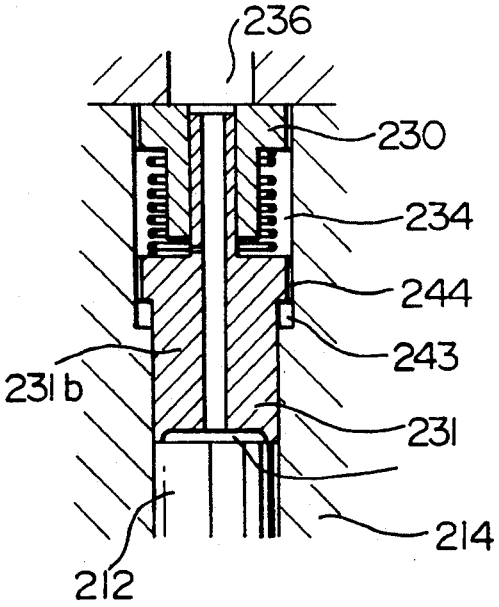

Thereafter, the high pressure in the control chamber 234 is released through the restriction passage 235 to lower the pressure in the control chamber. Accordingly, the piston 212 and the second valve member 231 are upwardly moved together to the fully lifted position of the piston 212, with a result that the rate of injection becomes maximum, as will be seen in FIG. 17C. At this time, the above-mentioned annular space 243 is formed between the outer peripheral surface of the sliding portion **231*b* and the inner peripheral surface of the pressure chamber 214. However, the communication grooves 244 formed in the second valve member 231 allow the fuel to flow from the control chamber into the annular space 243. The slidable engagement of the sliding portion 231***b* of the second valve member 231 with the inner peripheral surface of the cylinder 214 prevents the fuel in the annular space 243 from flowing into the back pressure chamber 233.

Figure 17D:
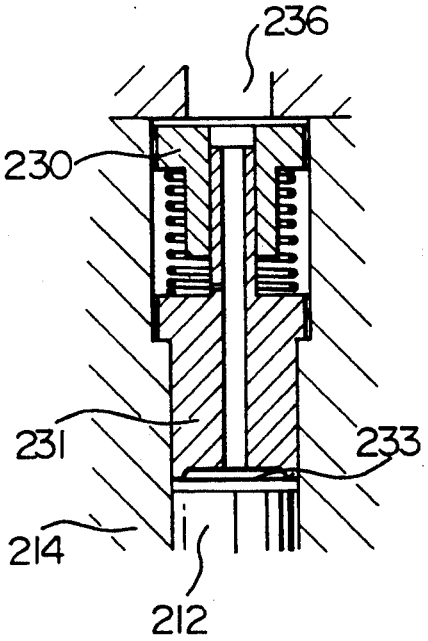

When the high pressure is again fed through the passage 236 into the back pressure chamber 233, this high pressure acts on the piston 212 and immediately moves the same downwards, as shown in FIG. 17D, with a result that the injection is terminated.

What is claimed is:

1. A Diesel fuel injection system having a nozzle needle for opening and closing an injection orifice comprising:

a high pressure accumulation means for accumulating fuel at high pressure;

an injector means for injecting fuel supplied by said high pressure accumulation means; said injector means comprising:

a pressure chamber for containing a pressure for acting upon said nozzle needle; said pressure chamber comprising means dividing said pressure chamber into a back pressure chamber, operative to cause said pressure in said pressure chamber to act directly upon said nozzle needle, and a control chamber, operative to act through said back pressure chamber upon said nozzle needle; said back pressure chamber causing said nozzle needle to lift a predetermined distance when said pressure in said pressure chamber is changed from a high pressure to a low pressure; said control chamber being operative to restrain movement of said nozzle needle for a predetermined time period after said pressure chamber has lifted said nozzle needle said predetermined distance, to provide a first injection rate characteristic in which an injection rate is substantially constant for said predetermined time period, thereafter said control chamber further lifting said nozzle needle upon a pressure drop in said control chamber to provide a subsequent second injection rate characteristic, said back pressure chamber and said control chamber being operative to decrease the lift of said nozzle needle upon a pressure rise in said pressure chamber to provide a subsequent third injection rate characteristic in which the injection rate is decreased from said second characteristic; and a control valve for allowing said pressure in said pressure chamber to be changed between a high pressure, supplied by said pressure accumulating means, and a low pressure, supplied by said injector means for causing an initial lifting of said nozzle needle and allowing fuel to be injected through said injector orifice.

2. A Diesel fuel injection device having a nozzle needle operative to open and close an injection orifice comprising:

a pressure accumulation means for accumulating a high pressure fuel;

a pressure chamber for containing a pressure to be applied to said nozzle needle;

a control valve for changing the pressure in said pressure chamber between a high pressure supplied by said pressure accumulation means and a low pressure, supplied by a low pressure side of said fuel injection device; said control valve operating said nozzle needle to lift, so that said high pressure fuel is injected through said injection orifice; and including a control means operative to control characteristic of injection rate in response to a change in the pressure in said pressure chamber; said injection rate characteristic having:

a first characteristic in which the injection rate is increased from a minimum injection rate to a second injection rate, in response to a change in said pressure of said pressure chamber from a high pressure to a low pressure, a second characteristic in which the injection rate is maintained at said second injection rate for a predetermined time period, a third characteristic in which the injection rate is gradually increased from said second injection rate to a third, maximum injection rate, and a fourth characteristic in which the injection rate is decreased, in response to a change in said pressure chamber pressure from a low pressure to a high pressure, from said third, maximum injection rate, to said minimum injection rate.

3. A Diesel fuel injection device according to claim 2, wherein said control means comprises a valve means disposed in said pressure chamber.

4. A Diesel fuel injection device having a nozzle needle operative to open and close an injection orifice comprising:

a pressure accumulation means for accumulating a high pressure fuel;

a pressure chamber for containing a pressure to be applied to said nozzle needle;

a control valve for changing the pressure in said pressure chamber between a high pressure supplied by said pressure accumulation means and a low pressure, supplied by a low pressure side of said fuel injection device; said control valve operating said nozzle needle to lift to inject said high pressure fuel through said injection orifice; and including control means operative to control the operation of said nozzle needle; said operation of said nozzle needle comprising:

a first stroke in which said nozzle needle is moved from a first position where said nozzle needle closes said injection orifice to a second position where said nozzle needle is lifted a predetermined distance, a second stroke in which said nozzle needle is maintained in said second position for a predetermined time period, a third stroke in which said nozzle needle is lifted from said second position to a third, maximum lift position, and a fourth stroke in which said nozzle needle is moved from said third, maximum lift position, to a fourth position where said nozzle needle closes said injection orifice;

said control means comprising first and second valve members arranged for relative movement with respect to one another, said first and second valve members cooperating together to divide said pressure chamber into a back pressure chamber and a control chamber, said back pressure chamber and said control chamber being communicated with each other through a restriction passage.

5. A Diesel fuel injection device according to claim 4, wherein said first valve member is biased by a resilient member and movable against said resilient member when the high pressure is introduced into said pressure chamber.

6. A Diesel fuel injection device according to claim 4, wherein said second valve member is engaged by said nozzle needle when said nozzle needle is lifted a predetermined distance, and said second valve member moves said nozzle needle to close said injection orifice based on the pressure in said control chamber.

7. A Diesel fuel injection device according to claim 4, wherein said restriction passage is formed in said first valve member.

8. A Diesel fuel injection device having a nozzle needle operative to open and close an injection orifice comprising:

a pressure accumulation means for accumulating a high pressure fuel;

a pressure chamber for containing a pressure to be applied to said nozzle needle;

a control valve for changing the pressure in said pressure chamber between a high pressure supplied by said pressure accumulation means and a low pressure, supplied by a low pressure side of said fuel injection device; said control valve operating said nozzle needle to lift, so that said high pressure fuel is injected through said injection orifice; and including a control means operative to control the operation of said nozzle needle; said operation of said nozzle needle comprising:

a first stroke in which said nozzle needle is moved from a first position where said nozzle needle closes said injection orifice to a second position where said nozzle needle is lifted a predetermined distance, a second stroke in which said nozzle needle is maintained in said second position for a predetermined time period, a third stroke in which said nozzle needle is lifted from said second position to a third, maximum lift position, and a fourth stroke in which said nozzle needle is moved from said third, maximum lift position, to a fourth position where said nozzle needle closes said injection orifice;

said control means comprises a valve means disposed in said pressure chamber; said valve means comprising first and second valve members arranged for relative sliding movement, said first and second valve members cooperating together to divide said pressure chamber into a back pressure chamber and a control chamber, said back pressure chamber and said control chamber being communicated with each other through a restriction passage, said second valve member is engaged by said nozzle needle when said nozzle needle is lifted a predetermined distance, and said second valve member moves said nozzle needle to close said injection orifice based on the pressure in said control chamber, and said second valve member has a communication groove for communicating said control chamber with a space which is defined in said pressure chamber by an outer periphery of said nozzle needle and said second valve member when said nozzle needle is lifted.

9. A Diesel fuel injection device according to clam 6, wherein said second valve member has an outer periphery disposed in sliding engagement with an inner peripheral surface of said pressure chamber, and the high pressure in said control chamber is introduced into said back pressure chamber through said restriction passage when said nozzle needle is lifted.

10. A Diesel fuel injection device according to claim 4, wherein said restriction passage is formed in said second valve member.

11. A Diesel fuel injection device having a nozzle needle operative to open and close an injection orifice comprising:

a pressure accumulation means for accumulating a high pressure fuel;

a pressure chamber for containing a pressure to be applied to said nozzle needle;

a control valve for changing the pressure in said pressure chamber between a high pressure supplied by said pressure accumulation means and a low pressure, supplied by a low pressure side of said fuel injection device; aid control valve operating said nozzle needle to lift, so that said high pressure fuel is injected through said injection orifice; and including a control means operative to control the operation of said nozzle needle; said operation of said nozzle needle comprising:

a first stroke in which said nozzle needle is moved from a first position where said nozzle needle closes said injection orifice to a second position where said nozzle needle is lifted a predetermined distance, a second stroke in which said nozzle needle is maintained in said second position for a predetermined time period, a third stroke in which said nozzle needle is lifted from said second position to a third, maximum lift position, and a fourth stroke in which said nozzle needle is moved from said third, maximum lift position, to a fourth position where said nozzle needle closes said injection orifice;

said control means comprises a valve means disposed in said pressure chamber; said valve means comprising first and second valve members arranged for relative sliding movement, said first and second valve members cooperating together to divide said pressure chamber into a back pressure chamber and a control chamber, said back pressure chamber and said control chamber being communicated with each other through a restriction passage, said second valve member is engaged by said nozzle needle when said nozzle needle is lifted a predetermined distance, and said second valve member moves said nozzle needle to close said injection orifice based on the pressure in said control chamber, and said second valve member comprises:

a flange being engaged with a shoulder formed in said pressure chamber;

a sliding portion slidable in a cylinder in which said nozzle needle in slidably received; and a communication groove formed in said flange for communicating said control chamber with a space defined in said pressure chamber by an outer periphery of said sliding portion and said flange when said nozzle needle is lifted.

12. A Diesel fuel injection device according to claim 2, wherein a restriction is provided in a passage extending between said control valve and said pressure chamber.

13. A Diesel fuel injection device having a nozzle needle operative to open and close an injection orifice comprising:

a pressure accumulation means for accumulating a high pressure fuel;

a pressure chamber for containing a pressure to be applied to said nozzle needle;

a control valve for changing the pressure in said pressure chamber between a high pressure supplied by a said pressure accumulation means and a low pressure, supplied by a low pressure side of said fuel injection device; said control valve operating said nozzle needle to lift so that said high pressure fuel is injected through said injection orifice; and including a control means operative to control the injection rate characteristics; the injection rate having a first characteristic in which the injection rate is substantially constant for a predetermined time period, a subsequent second characteristic in which the injection rate is gradually increased from said first characteristic, and a subsequent third characteristic in which the injection rate is suddenly decreased from said second characteristic.

14. A Diesel fuel injection device according to claim 13, wherein said control means comprises a valve means disposed in said pressure chamber.

15. A Diesel fuel injection device according to claim 14, wherein said vale means comprises first and second valve members arranged for relative sliding movement, said first and second valve members cooperating together to divide said pressure chamber into a back pressure chamber and a control chamber, said back pressure chamber and said control chamber being communicated with each other through a restriction passage.

16. A Diesel fuel injection device according to claim 15, wherein said first valve member is biased by a resilient member and movable against said resilient member when the high pressure is introduced into said pressure chamber.

17. A Diesel fuel injection device according to claim 15, wherein said second valve member is engaged by said nozzle needle when said nozzle needle is lifted a predetermined distance, and said second valve member moves said nozzle needle to close said injection orifice based on the pressure in said control chamber.

18. A Diesel fuel injection device according to claim 15, wherein said restriction passage is formed in said first valve member.

19. A Diesel fuel injection device according to claim 17, wherein said second valve member has a communication groove for communicating said control chamber by an outer periphery of said nozzle needle and said second valve member when said nozzle needle is lifted.

20. A Diesel fuel injection device according to claim 17, wherein said second valve member has an outer periphery disposed in sliding engagement with an inner peripheral surface of said pressure chamber, and the high pressure in said control chamber is introduced into said back pressure chamber through said restriction passage when said nozzle needle is lifted.

21. A Diesel fuel injection device according to claim 15, wherein said restriction passage is formed in said second valve member.

22. A diesel fuel injection device according to claim 17, wherein said second valve member comprises:

a flange being engaged with a shoulder formed in said pressure chamber;

a sliding portion slidable in a cylinder in which said nozzle needle is slidably received; and a communication groove formed in said flange for communicating said control chamber with a space defined in said pressure chamber by an outer periphery of said sliding portion and said flange when said nozzle needle is lifted.

23. A Diesel fuel injection device according to claim 13, wherein a restriction is provided in a passage extending between said control valve and said pressure chamber.

* * * * *